US005494102A

United States Patent [19]

Schulte

[11] Patent Number: 5,494,102

[45] Date of Patent: Feb. 27, 1996

[54] DOWNHOLE HYDRAULICALLY OPERATED FLUID PUMP

[76] Inventor: Warren H. Schulte, 60 S. Circlewood Glen, The Woodlands, Tex. 77381-2607

[21] Appl. No.: 410,958

[22] Filed: Mar. 27, 1995

[51] Int. Cl.[6] ..... E21B 43/00

[52] U.S. Cl. ..... 166/105.6; 417/403; 417/264

[58] Field of Search ..... 166/105, 105.5, 166/105.6; 417/259, 264, 403

[56] References Cited

U.S. PATENT DOCUMENTS

| | | | |
|---|---|---|---|
| 3,703,926 | 11/1972 | Roeder | 166/106 |
| 3,865,516 | 2/1975 | Roeder | 417/403 |
| 4,214,854 | 7/1980 | Roeder | 417/402 |
| 4,268,227 | 5/1981 | Roeder | 417/358 |
| 4,295,801 | 10/1981 | Bennett | 417/397 |
| 4,383,803 | 5/1983 | Reese | 417/259 |
| 4,390,326 | 6/1983 | Callicoaite | 417/401 |
| 4,544,335 | 10/1985 | Roeder | 417/401 |
| 4,664,186 | 5/1987 | Roeder | 166/106 X |
| 4,720,247 | 1/1988 | Strickland et al. | 417/392 |
| 4,925,354 | 5/1990 | Carrens | 417/403 |
| 5,104,296 | 4/1992 | Roeder | 417/403 |

*Primary Examiner*—Roger J. Schoeppel

*Attorney, Agent, or Firm*—Kenneth A. Roddy

[57] ABSTRACT

A downhole hydraulically operated pump having a power piston reciprocated by alternating pressurized hydraulic fluid flow controlled at the surface by a hydraulic power control system which quickly reverses the flow direction. The pump housing, suspended in the well fluid of a cased well by a discharge tube, has a power piston chamber in which the power piston is housed, a production piston chamber in which a production piston is housed, and an intermediate fluid and gas collection chamber disposed therebetween. The power piston, production piston, and a suction filter are connected by an elongate hollow tubular piston rod to reciprocate together and the piston rod interior is in communication with the discharge tube. On up strokes, a series of check valves direct well fluid upwardly through the suction filter, the piston rod interior, the production piston, the production piston chamber, the piston rod interior, and into the discharge tube. Entrapped well fluid in the production piston chamber is forced upwardly through a check valve, the intermediate fluid and gas collection chamber, the interior of the piston rod and to the surface through the discharge tube. On down strokes well fluid entrapped beneath the production piston is expelled upwardly through the production piston, the piston rod interior, and into the discharge tube.

17 Claims, 3 Drawing Sheets

15
13
27
12
29
22
24
17
32
16
19
20
77
73
75
76
21
18
40
39
37
71A
58
51
46
52
53
55
54
56
57
69
70
14
C
28
10
29
11
23
30
25
33
26
31
41A
41
74
76
78
77
41B
41
21
35
36
34
44
43
35
P
70
70
71
49
43
47
50
48
45
61
46
60
59
69A
71
70
69
69A
59
103
72
83
10
106
91
80
79
89
81
101
90
100
102
108
104
109
114
105
107
82
95
86
94
96
88
85
99
97
87
84
98
93
92
110
113
112
69
69B
66
68
60
67
63
62
64
65
111
120
C
119
H
H

DOWNHOLE HYDRAULICALLY OPERATED FLUID PUMP

BACKGROUND OF THE INVENTION

1. Field of the Invention

This invention relates generally to submersible, fluid powered pumps, and more particularly to a hydraulically operated fluid pump having a power piston reciprocated by pressurized hydraulic fluid, a pump housing having a power piston chamber in which the power piston is housed, a production piston chamber in which a production piston is housed, and an intermediate fluid and gas collection chamber disposed therebetween and the power piston, production piston, and a suction filter are connected by an elongate hollow tubular piston rod to reciprocate together.

2. Brief Description of the Prior Art

Mechanically operated positive displacement pumps, used for the extraction of petroleum fluids, brine, or water, are normally connected to surface machinery through an elongate operating puller, or sucker rod, which can operate only in straight and truly vertical bored holes. Surface operated mechanical pumps are not particularly suited for slanted wells, bent wells, and horizontal wells.

Due to the high cost of the surface machinery, such as the pumping jack and the sucker rod, and the maintenance costs of the mechanical system, the mechanically operated deep well pumps are cost effective only in the wells of high productivity. The output of mechanically operated pumps is limited to no more than one-sixth of the natural frequency of the elastic interaction of the sucker rod pipe and the bulk modulus of the pumped fluid.

Hydraulically operated single acting positive displacement piston pumps are a different type of pump wherein the power or pumping stroke and the return or recharge stroke is accomplished by the combination of hydraulic pressure and spring pressure, or the combination of hydraulic pressure and compressed gas pressure.

Most hydraulically operated pumps utilize a considerable volume of effective operating fluid and are limited to the number of pumping cycles per minute due to the cyclic operations of pressurization and recovery, the expansion and contraction of the pressure line, the fluid friction during downhole and return flow cycles, and fluid viscosity.

Roeder, U.S. Pat. No. 4,214,854 discloses a downhole hydraulically actuated pump having an engine reciprocatingly connected to a production pump. Power fluid is conducted downhole to the engine of the pump assembly, while production fluid and spent power fluid is conducted uphole to the surface. The pump assembly includes a housing within which spaced, axially aligned, cylindrical chambers reciprocatingly receive spaced engine and pump pistons which are connected together in a manner to enable the engine to reciprocate the production pump. A mechanically actuated valve assembly is contained within the engine piston and is arranged respective to various different flow passageways so that flow of power fluid through the engine forces the engine piston to reciprocate. The valve assembly includes a control rod and a valve element concentrically arranged respective to one another and to the engine piston. The valve element is reciprocated respective to the engine piston in response to reciprocation of the control rod. Abutment means formed on the engine cylinder shifts the control rod each stroke of the piston, thereby causing the valve element to shift respective to the piston, whereupon various different flow passageways are aligned with one another to cause power fluid to be effected upon the engine in such a manner that the engine piston reciprocates to thereby force the pump piston to be reciprocated within its cylinder.

Bennett, U.S. Pat. No. 4,295,801 discloses a small diameter fluid-driven pump for subterranean fluid sampling which has an elongated cylindrical body formed by a centrally disposed control valve block assembly and a pair of hollow motor piston chambers on opposite sides of the valve block and joined thereto. Within the centrally disposed control valve block assembly in axial alignment with the motor pistons are a spool pilot valve and a spool fluid distribution valve. The spool pilot valve is constructed to obviate stalling during its reciprocation under the impress of a power fluid directed thereto, and it functions to control the shifting of the distribution valve to which it is internally connected within the valve block assembly. The spool pilot valve includes a valve housing defining a large central piston chamber, a relatively small bore extending axially inwardly from one end of the valve housing, and into communication with the large central piston chamber, and a larger bore of smaller diameter than the central piston chamber extending axially into the opposite end of the valve housing into communication with the central piston chamber. A small piston is slidably positioned in the relatively small bore, a larger piston in the larger bore and a largest piston in the central piston chamber. A power fluid charging port communicates with the central piston chamber through the valve housing, and inlet and exhaust ports communicate with each of the bores. Sealing means on the largest piston in the central piston chamber allows power fluid to bleed from the power fluid charging port to opposite sides of the largest piston when this sealing means is directly aligned with the power fluid charging port.

Reese, U.S. Pat. No. 4,383,803 discloses a device for lifting liquid from boreholes comprising a pump which is located downhole in the region of a production formation and which consists of a fluid-actuated, double-action piston. The pump is connected by fluid pressure lines to a source of fluid pressure disposed above ground and a switching valve is connected to provide fluid pressure to alternate sides of the piston to effect reciprocation thereof.

Roeder, U.S. Pat. No. 4,544,335 discloses a downhole hydraulically actuated pump assembly of either the free or fixed type having a power piston which actuates a production plunger. A valve is concentrically arranged within the power piston. A stationary, hollow valve control rod extends through the power piston and through the valve, with a lower marginal end of the control rod terminating within the production plunger. Power fluid flows through the control rod and to the valve. As the power piston reciprocates within the engine cylinder, means on the control rod actuates the valve between two alternate positions so that power fluid is applied to the bottom face of the power piston to thereby cause the power piston to reciprocate upward; and thereafter, the control rod causes the valve to shift to the other position, whereupon spent power fluid is exhausted from the engine cylinder. The spent power fluid is admixed with production fluid and is conducted to the surface.

Strickland et al, U.S. Pat. No. 4,720,247 discloses an oil well reciprocating piston pump which is operated from a source at the earth's surface. The piston is hollow and also serves as a sealed cylinder for a free piston which is gas biased downwardly. The underside of the free piston is in contact with a body of oil displaceable from the sealed cylinder into the annular space between the hollow piston and its cylinder to bias the hollow piston toward the bottom end of its stroke.

Carrens, U.S. Pat. No. 4,925,374 discloses a sub-surface hydraulically operated engine for reciprocating an oilwell pumping unit which includes confined hydraulic fluid means for actuating a reversing valve and its lifter in order to change the upstroke motion to downstroke motion and vice-versa.

Roeder, U.S. Pat. No. 5,104,296 discloses a hydraulically actuated downhole pump powered by a fluid that is pumped downhole to an engine end thereof. The pump assembly has a pump end which is connected to a source of formation fluid so that the engine end drives the pump end and the pump end lifts produced fluid to the surface of the ground. The pump end has a pump barrel and a pump piston is reciprocatingly received in sealed relationship within the pump barrel. The engine end has an outer engine barrel, and an annular valve element is reciprocatingly received in sealed relationship within the outer barrel. The valve element moves up and down between two positions of operation while an engine piston reciprocates within the annular valve element and in so doing aligns various flow passageways in a manner to alternately apply power fluid to appropriate sides of the piston and valve element to force the engine piston to reciprocate. The valve element shifts between the two alternate positions at the end of each of the engine piston strokes. This configuration of an engine end reduces the complexity of the engine end and allows loose tolerances to be used in fabricating the engine end.

The present invention is distinguished over the prior art in general, and these patents in particular by a downhole hydraulically operated pump having a power piston reciprocated by alternating pressurized hydraulic fluid flow controlled at the surface by a hydraulic power control system which includes a spool valve and electric solenoid controlled directional valves which quickly reverse the flow direction. The pump housing, suspended in the well fluid of a cased well by a discharge tube, has a power piston chamber in which the power piston is housed, a production piston chamber in which a production piston is housed, and an intermediate fluid and gas collection chamber disposed therebetween. The power piston, production piston, and a suction filter are connected by an elongate hollow tubular piston rod to reciprocate together and the piston rod interior is in communication with the discharge tube. On up strokes, a series of check valves direct well fluid upwardly through the suction filter, the piston rod interior, through the production piston, into the production piston chamber, and from the production piston chamber through the production piston into the piston rod interior, and into the discharge tube. Entrapped well fluid in the production piston chamber is forced upwardly through a check valve, into the intermediate fluid and gas collection chamber, into the interior of the piston rod through a side bore, and to the surface through the discharge tube. On down strokes well fluid entrapped beneath the production piston is expelled upwardly through the production piston, into the piston rod interior, and into the discharge tube.

SUMMARY OF THE INVENTION

It is therefore an object of the present invention to provide a surface controlled hydraulically operated positive displacement fluid pump having a power piston reciprocated by alternating pressurized hydraulic fluid to drive a production piston.

It is another object of this invention to provide a hydraulically operated positive displacement fluid pump controlled by a hydraulic power control system which includes a spool valve and electric solenoid controlled directional valves which reverses the power fluid flow direction in milliseconds.

Another object of this invention is to provide a hydraulically operated positive displacement fluid pump having an improved pump housing arrangement having a hydraulic power piston chamber in which the power piston is housed, a production piston chamber in which the production piston is housed, and an intermediate fluid and gas collection chamber disposed therebetween.

Another object of this invention is to provide a hydraulically operated positive displacement fluid pump having a hydraulic power control system which is responsive to the production output of the well.

Another object of this invention is to provide a hydraulically operated positive displacement fluid pump which eliminates gas and vapor lock during the pumping operation.

Another object of this invention is to provide a hydraulically operated positive displacement fluid pump having a minimum number of moving parts.

Another object of this invention is to provide a hydraulically operated positive displacement fluid pump which can be employed in vertical, bowed, angularly deviated, and horizontal wells including low production wells.

A further object of this invention is to provide a hydraulically operated positive displacement fluid pump which has a self-cleaning filter arrangement to reduce ingestion of sand in the well fluid.

A still further object of this invention is to provide a hydraulically operated positive displacement fluid pump which is simple in construction, rugged and reliable in operation, and inexpensive to manufacture.

Other objects of the invention will become apparent from time to time throughout the specification and claims as hereinafter related.

The above noted objects and other objects of the invention are accomplished by a downhole hydraulically operated pump having a power piston reciprocated by alternating pressurized hydraulic fluid flow controlled at the surface by a hydraulic power control system which includes a spool valve and electric solenoid controlled directional valves which quickly reverse the flow direction. The pump housing, suspended in the well fluid of a cased well by a discharge tube, has a power piston chamber in which the power piston is housed, a production piston chamber in which a production piston is housed, and an intermediate fluid and gas collection chamber disposed therebetween. The power piston, production piston, and a suction filter are connected by an elongate hollow tubular piston rod to reciprocate together and the piston rod interior is in communication with the discharge tube. On up strokes, a series of check valves direct well fluid upwardly through the suction filter, the piston rod interiors through the production piston, into the production piston chamber, and from the production piston chamber through the production piston into the piston rod interior, and into the discharge tube. Entrapped well fluid in the production piston chamber is forced upwardly through a check valve, into the intermediate fluid and gas collection chamber, into the interior of the piston rod through a side bore, and to the surface through the discharge tube. On down strokes well fluid entrapped beneath the production piston is expelled upwardly through the production piston, into the piston rod interior, and into the discharge tube.

DESCRIPTION OF THE PREFERRED EMBODIMENT

Figures 1A, 1B:
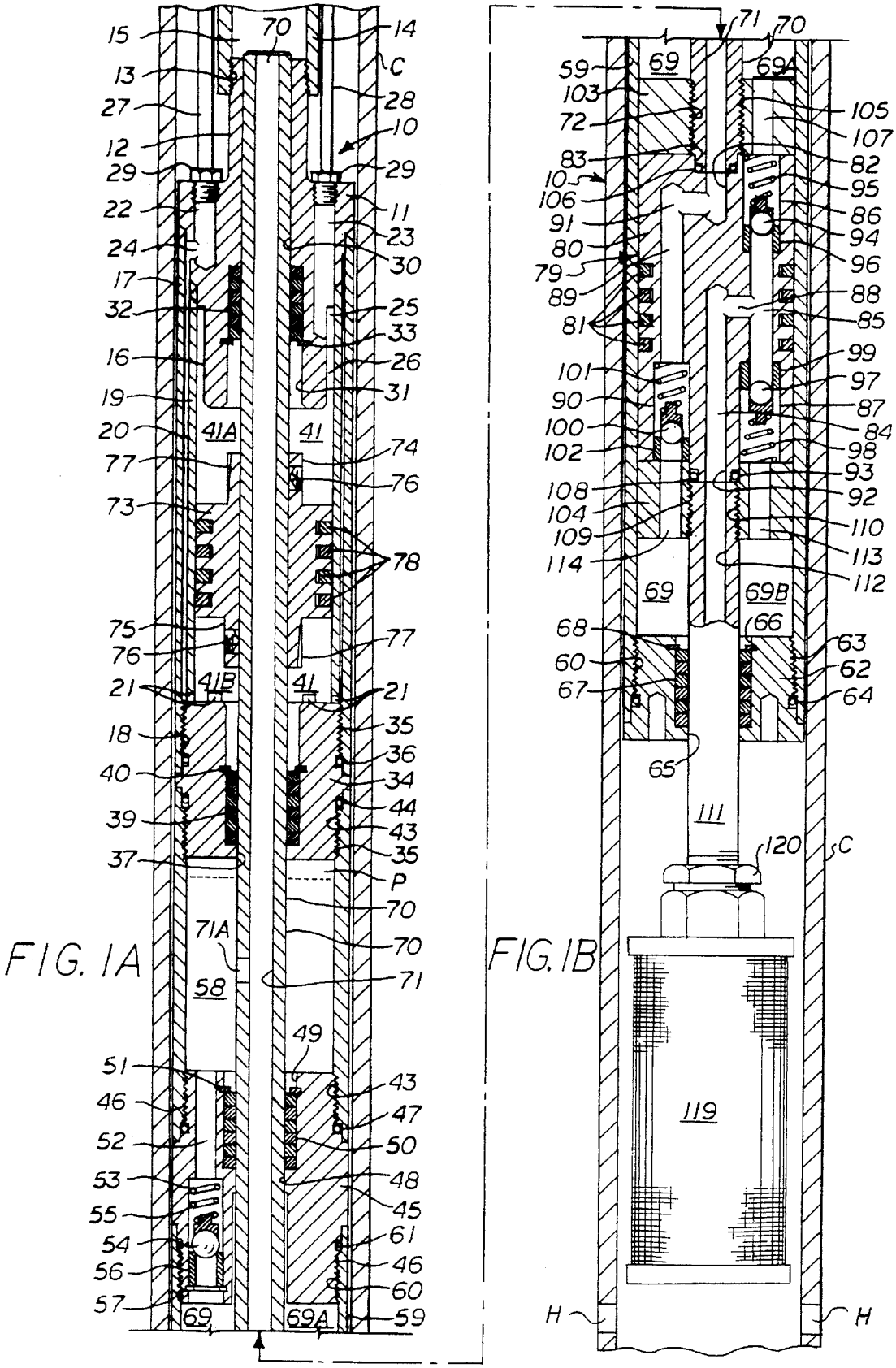
FIGS. 1A and 1B taken together is a longitudinal cross section of the hydraulically operated pump in accordance with the present invention.

Referring to the drawings by numerals of reference, there is shown in FIGS. 1A and 1B, a preferred hydraulically operated positive displacement fluid pump 10 installed in a well bore casing C. The lower portion of the casing C has holes H through the side wall to allow entry of well fluid into the casing from the surrounding well formation.

The pump 10 is an elongate tubular assembly enclosed at its upper end by a cylindrical upper cylinder head 11. The exterior of the upper portion of the cylinder head 11 has a reduced diameter neck portion 12 threadedly engaged by external threads 13 to a discharge tube 14 which extends to the surface of the well and has a central bore 15 that conducts the pumped fluid into an above-ground storage facility (not shown). The lower end of the cylinder head 11 has a reduced diameter 16. An elongate tubular outer sleeve 17 is secured at its upper end, such as by welding, to the exterior of the cylinder head 11 and has internal threads 18 at its bottom end. An elongate tubular inner sleeve 19 is secured at its upper end to the exterior of the cylinder head 11, such as by welding, in inwardly concentric spaced relation to the outer sleeve 17 to define an annulus 20 therebetween. The bottom end of the inner sleeve 19 has a plurality of slots 21 in communication with the annulus 20.

A pair of bores 22 and 23 laterally spaced from the neck portion 12 extend downwardly from the upper portion of the cylinder head 11. A short bore 24 extends laterally inward from the exterior of the cylinder head 11 between the upper ends of the outer and inner sleeves 17 and 19 to join the bore 22 to the annulus 20 between the inner and outer sleeves, and a short bore 24 extends laterally from the reduced diameter lower end 16 of the cylinder head 11 beneath the upper end of the inner sleeve 19 to join the bore 25 to the annulus 26 between the reduced diameter 16 and the inner sleeve 19. A pair of hydraulic fluid conduits 27 and 28 are connected at their bottom ends to the bores 22 and 23 by threaded fittings 29, and may be fastened to the discharge pipe 14 at points along their length. The upper end of the hydraulic fluid conduits 27 and 28 are connected at the well surface to a central hydraulic power control circuit (described hereinafter).

A central bore 30 extends through the upper portion of the cylinder head 11 and a larger diameter cavity 31 extends upwardly a distance from the reduced diameter lower end 16. A reciprocating seal assembly 32 is retained in the cavity 31 by a retaining ring 33.

A short cylindrical guide member 34 having external threads 35 at each end is threadedly connected at its upper end to the threaded bottom end of the outer sleeve 17, with an elastomeric O-ring seal 36 sealing the threaded connection. The bottom slotted end 21 of the inner sleeve 19 is received on the top surface of the guide member 34. The guide member 34 has a central bore 37, and a larger diameter cavity 38 extending downwardly a distance from its top end. A reciprocating seal assembly 39 is retained in the cavity 38 by a retaining ring 40. The interior of the inner sleeve 19 between the reduced diameter lower portion 16 of the cylinder head 11 and the top of the guide 34 defines a power piston chamber 41 which is surrounded by the annulus 20 between the inner and outer sleeves 19 and 17.

A tubular sleeve 42 having internal threads 43 at each end is threadedly connected at its upper end to the lower portion of the guide member 34 with an elastomeric O-ring seal 44 sealing the threaded connection.

A short cylindrical valve housing 45 having external threads 46 at each end is threadedly connected at its upper end to the threaded bottom end of the sleeve 42, with an elastomeric O-ring seal 47 sealing the threaded connection. The valve housing 45 has a central bore 48, and a larger diameter cavity 49 extending downwardly a distance from its top end. A reciprocating seal assembly 50 is retained in the cavity 49 by a retaining ring 51. A bore 52 spaced laterally from the central bore 48 extends through the valve housing 45 and a counterbore 53 extends upwardly a distance from its bottom end. A one-way check valve 54 having a spring 55 and a valve seat 56 is retained in the counterbore 53 by a retaining ring 57 and allows well fluid to pass upwardly through the valve housing 45 but prevents it from passing downwardly. The interior of the sleeve 42 between the bottom end of the guide member 34 and the top of the valve housing 45 define an intermediate fluid and gas collection chamber 58.

An elongate tubular sleeve 59 having internal threads 60 at each end is threadedly connected at its upper end to the lower portion of the valve housing 45 with an elastomeric O-ring seal 61 sealing the threaded connection. A short cylindrical lower cylinder head 62 having external threads 63 at its upper end is threadedly connected to the threaded bottom end of the sleeve 59, with an elastomeric O-ring seal 64 sealing the threaded connection. The lower cylinder head 62 has a central bore 65, and a larger diameter cavity 66 extending downwardly a distance from its top end. A reciprocating seal assembly 67 is retained in the cavity 66 by a retaining ring 68. The interior of the elongate sleeve 59 between the bottom of the valve housing 45 and the top of the lower cylinder head 62 defines a production piston chamber 69.

In FIGS. 1A and 1B, the reciprocating components of the pump 10 are shown in an intermediate position halfway between the top of the up stroke and the bottom of the down stroke.

An elongate hollow tubular piston rod 70 is slidably received through the bore 30 and seal assembly 32 in the upper cylinder head 11, the bore 37 and seal assembly 39 in the guide member 34, and the bore 48 and seal assembly 50 in the valve housing 45. The tubular piston rod 70 has a central bore 71 in fluid communication at its upper end with the bore 15 of the discharge tube 14 and an externally threaded bottom end 72. A bore 71A extends laterally through the side wall of the piston rod 70 at a location beneath the bottom end of the guide member 34 to allow fluid and gas communication between the central bore 71 of the piston rod and the intermediate fluid and gas collection chamber 58 between the bottom end of the guide member 34 and the top of the valve housing 45.

A power piston 73 having a reduced neck portion 74 and 75 at each end is secured by welds 76, or other conventional means, to the piston rod 70 and travels in the power piston chamber 41 between the reduced diameter lower portion 16 of the cylinder head 11 and the top of the guide 34 and divides the chamber 41 into an upper portion 41A and a lower portion 41B. The reduced diameter neck portions 74 and 75 are of sufficient diameter to be received in the cavities 31 and 38, respectively, and each has an angular slot 77 extending longitudinally along their exterior diameter. The power piston 73 has a plurality of longitudinally spaced piston rings 78 on its exterior which engage the interior of the inner sleeve 19 in reciprocating sealing relation.

The externally threaded bottom end 72 of the piston rod 70 is threadedly connected to a composite production piston 79 slidably disposed in the production piston chamber 69 between the valve housing 45 and the lower cylinder head 62. The composite production piston 79 has a cylindrical main body 80 with a plurality of longitudinally spaced piston rings 81 on its exterior which engage the interior of the elongate sleeve 59 in reciprocating sealing relation. An upper central bore 82 extends a distance downwardly from the top end of the main body 80 and has a short counterbore 83. A lower central bore 84 extends a distance upwardly from the bottom end of the main body 80. A first bore 85 laterally spaced to one side of the central bores 82 and 84 extends through the main body 80 and has a counterbore 86 and 87 at each end. A short bore 88 extends laterally between the bore 85 and the lower central bore 84. A second bore 89 laterally spaced to one side of the central bores 82 and 84 extends upwardly from the bottom end of the main body 80 and has a counterbore 90 at the bottom end. A short bore 91 extends laterally between the bore 89 and the upper central bore 82. The main body 80 has a central short tubular extension 92 on it's bottom end with an elastomeric O-ring 93 installed on it's exterior.

A first one-way check valve 94 having a spring 95 and a valve seat 96 is installed in the counterbore 86 at the top end of the bore 85, and a second one-way check valve 97 having a spring 98 and a valve seat 99 is installed in the counterbore 87 in opposed facing relation to the first check valve 94. A third one-way check valve 100 having a spring 101 and a valve seat 102 is installed in the counterbore 90 at the bottom end of the bore 89.

The check valves 94, 97, and 100 are retained in the counterbores by circular end plates 103 and 104 secured to the top and bottom ends, respectively of the main body 80. The upper end plate 103 has a central internally threaded bore 105 coaxial with the upper central bore 82 in the main body 80. The externally threaded bottom end 72 of the piston rod 70 is threadedly connected in the threaded bore 105 with its bottom end received in the counterbore 83 and an elastomeric O-ring 106 seals the threaded connection. The bore 71 of the piston rod 70 is in fluid communication with the upper central bore 82 in the main body 80. The upper plate 103 has a bore 107 laterally spaced from the threaded bore 105 which extends through the plate in axial alignment with the bore 85 and counterbore 86 in the main body 80. The bore 107 is smaller in diameter than the counterbore 86 and retains the outer end of the spring 95 of the check valve 94.

The lower end plate 104 has a central bore 108 with an internally threaded lower portion 109 coaxial with the lower central bore 84 in the main body 80. The bore 108 receives the tubular extension 92 at the bottom of the main body 80. The externally threaded top end 110 of a tubular lower piston rod extension 111 is threadedly connected in the threaded bore 109 and the elastomeric O-ring 93 provides a seal above the threaded connection. The bore 112 of the lower piston rod extension 111 is in fluid communication with the upper central bore 84 in the main body 80. The lower plate 104 has a first bore 113 laterally spaced from the threaded bore 109 which extends through the plate in axial alignment with the bore 85 and counterbore 87 the main body 80. The bore 113 is smaller in diameter than the counterbore 87 and retains the outer end of the spring 98 of the check valve 97. A second bore 114 laterally spaced from the threaded bore 109 extends through the lower plate 104 in axial alignment with the bore 89 and counterbore 90 in the main body 80. The bore 114 is smaller in diameter than the counterbore 90 and retains the outer end of the seat 102 of the check valve 100.

Figure 2:
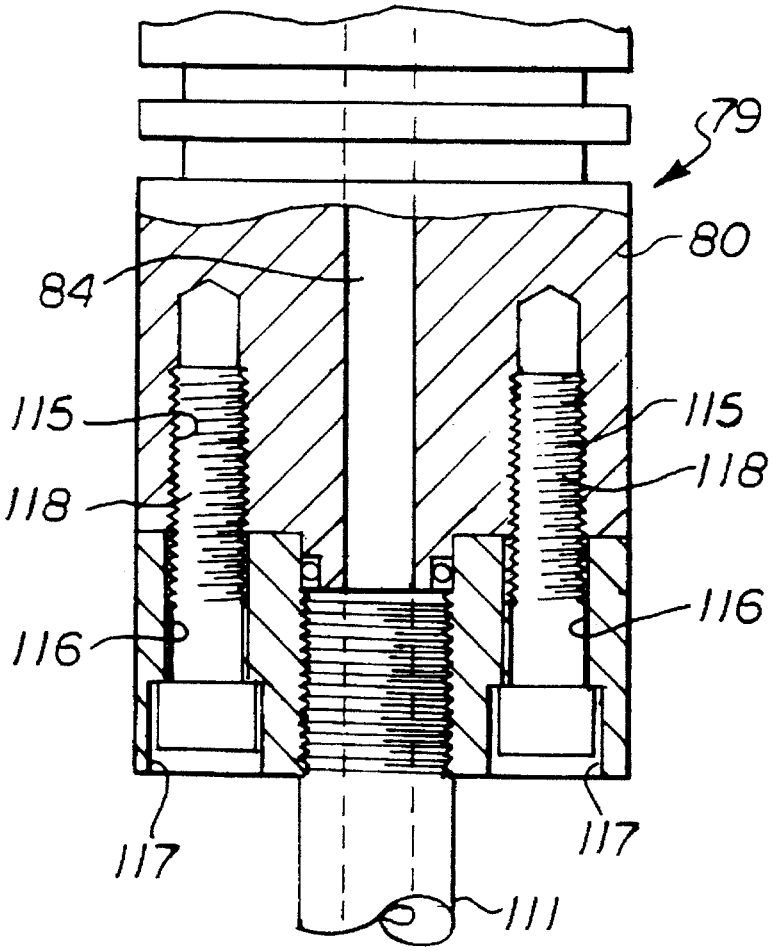
FIG. 2 is a longitudinal cross section of the main body of the production piston taken at 90° from that shown in FIG. 1B showing the lower plate connection detail.
Figure 3:
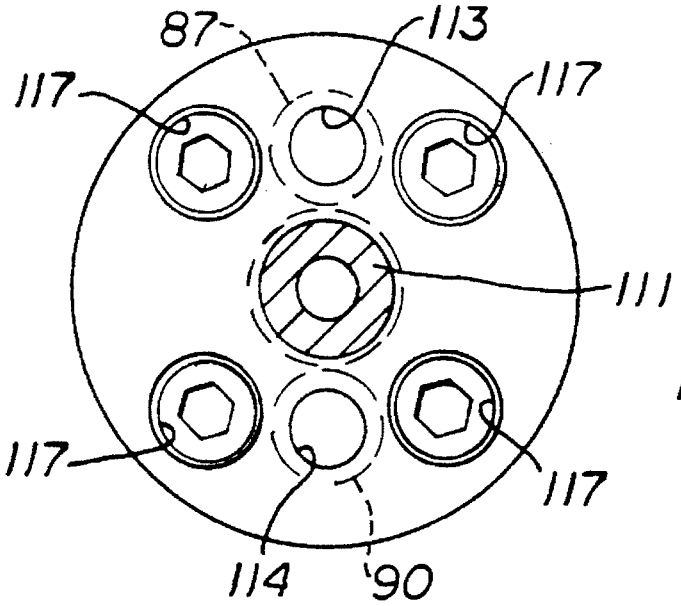
FIG. 3 is a plan view of the lower plate.

FIGS. 2 and 3 show how the lower plate 104 is connected to the main body 80 of the composite production piston 79. The main body 80 has circumferentially spaced threaded bores 115 extending inwardly from its bottom end and the lower plate 104 has circumferentially spaced bores 116 and counterbores 117 axially aligned therewith. A cap screw 118 installed through each of the bores 116 in the lower plate 104 is threadedly engaged in the threaded bores 115 in the main body 80 to secure the lower plate thereon. Although not shown, the upper plate 103 is secured to the main body 80 in the same manner as the lower plate 104.

Referring again to FIGS. 1A and 1B, the hollow tubular lower piston rod extension 111 is slidably received through the bore 65 and seal assembly 67 in the lower cylinder head 62 and its lower end is connected to the top end of a suction filter or strainer 119 by a threaded connector 120. The suction filter or strainer 119 reciprocates with the piston rod 70 and piston rod extension 111.

The production piston 79 divides the production piston chamber 69 into an upper chamber 69A and a lower chamber 69B. The first one-way check valve 94 at the top end of the production piston 79 allows well fluid entering the suction filter or strainer 119, the bore 112 of the lower piston rod extension 111, the central bore 84 in the lower end of the production piston 79, the bore 88, and the bore 85, to pass upwardly through the bore 107 in the upper plate 103 to enter upper production piston chamber 69A, but prevents it from passing downwardly. The opposed second one-way check valve 97 at the bottom end of the production piston 79 allows well fluid entering the central bore 84 in the lower end of the production piston 79, the bore 88, and the bore 85, to pass downwardly through the bore 113 in the lower plate 104 to enter the lower production piston chamber 69B, but prevents it from passing upwardly. The third one-way check valve 100 allows well fluid to pass upwardly through the bore 114 in the lower plate 104 and the bores 89 and 91 and central bore 82 in the production piston 79 into the bore 71 of the hollow tubular piston rod 70, but prevents it from passing downwardly.

It should be noted that in the present pumping unit, all pressure discharge conduits and valves in the pumped fluid flow path are facing upward, or forward, for easy advancement of gas bubbles to the discharge.

Figure 4:
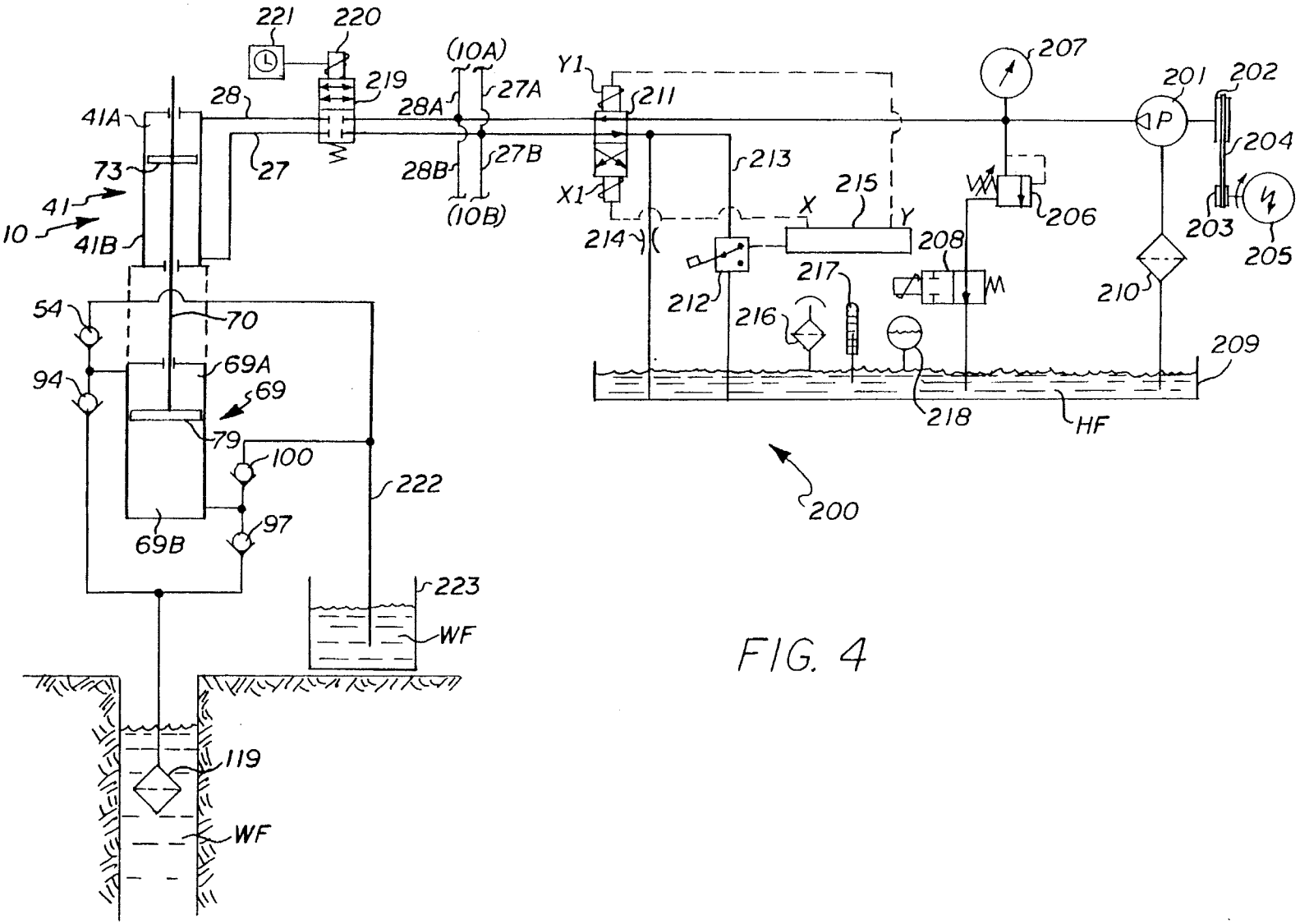
FIG. 4 is a schematic drawing showing the hydraulic power control system for operating a single pumping unit with provisions for operating additional pumping units.

Referring now to FIG. 4, there is shown schematically, a preferred central hydraulic power control circuit 200 which is disposed at the surface of the well and conducts the pressurized hydraulic fluid alternately through the hydraulic conduits 27 and 28 to the bottom and top of the power piston 73 to control the operation of the power piston. FIG. 4 shows the hydraulic power control circuit 200 operating a single pumping unit 10, with provisions for operating additional pumping units 10A and 10B via branches 27A, 28A and 27B, 28B of conduits 27 and 28.

In FIG. 4, the pumping unit 10, power piston chamber 41, production piston chamber 69 and valving arrangement, are represented schematically, and the check valves 54, 94, 97, and 100 are shown connected between their respective chambers and reservoirs by exterior hydraulic conductor lines, rather than through passageways in the production piston 79 and hollow piston rod 70, to avoid confusion.

A positive displacement pump 201 is driven through a driver 202 and driver pulleys 203 connected by belt drive 204 to a prime mover 205. The positive displacement pump 201 is protected from overpressure, and pressure peaks, by an adjustable relief valve 206. The maximum pressure setting of the relief valve 206 is indicated by a pressure gauge 207, and the relief valve is equipped with a remotely activated solenoid pilot valve 208. The relief valve 206, when vented by the pilot valve 208, unloads the positive displacement pump 201 at low pressure, to a hydraulic fluid reservoir 209. The inlet of the pump 201 is protected from damage by large particles by a suction strainer 210.

The hydraulic fluid HF, pressurized by the positive displacement pump 201, is directed through a directional flow control valve 211, to the pumping unit 10 (10A, 10B). As noted above, pumping unit 10 is schematically depicted.

The central hydraulic power control circuit 200 is equipped with a fluid flow sensitive switch 212 in a bypass 213 between a restricted return 214 in the hydraulic fluid flow return line 27 and the hydraulic fluid reservoir 209.

An electronic "flip-flop" 215 receives a signal from the flow control switch 212 and alternately energizes the "X" and "Y" signal lines connected to the pilot solenoids X1 and Y1 of the flow control valve 211, which function as described hereinafter.

The hydraulic fluid reservoir 209 is equipped with a filter/breather-dryer 216, oil temperature indicator 217, and an oil level window 218.

Each pumping unit 10 (10A, 10B) is individually equipped with a flow blocking valve 219 in the conduits 27 and 28 (27A, 28A and 27B, 28B) remotely operated from a central process controller (not shown). The blocking valves 219 are activated simultaneously with the solenoid pilot valve 208. Each flow blocking valve 219 is equipped with a solenoid 220 and a timing device 221 that is adjusted to the well fluid recovery cycle, either manually or by the memory of the process controller.

As described previously, the power piston 73 and the production piston 79 are connected to the hollow piston rod 70 to reciprocate in the respective power piston chamber 41 and production piston chamber 69 in unison.

The upper and lower chambers 69A and 69B of the pump piston chamber 69 receive well fluid WF through the common suction strainer 119 and inlet check valves 94 and 97 and discharge the well fluid through discharge check valves 54 and 100 into the hollow piston rod 70 and through a common discharge line 222 to a well fluid reservoir 223.

OPERATION OF HYDRAULIC POWER CONTROL SYSTEM

The hydraulic power control circuit 200, as represented in FIG. 4, is shown with the flow control valve 211 conducting hydraulic fluid flow at "parallel ports" as represented by the arrows within the valve envelope 211. The hydraulic fluid flow is stopped by the blocking valve 219, until activation of the solenoid 220 by the process controller (not shown), and timing device 221 to switch the blocking valve 219 to flow conduction, and de-energize the unloading pilot valve 208 of the relief valve 206, that in turn allows the pump 201 to build up the hydraulic pressure, and operate the power piston 73 in the down direction (cycle) through conduit 28.

At the same time, the return hydraulic fluid flow from the power piston chamber 41 is directed via conduit 27, through blocking valve 219, directional flow control valve 211, and through the bypass restriction 214, and parallel flow switch 212 to the hydraulic fluid reservoir 209.

Simultaneously, the production piston 79 in the production piston chamber 69 is lowering and expelling the well fluid WF from the lower chamber 69B, through discharge check valve 100, into the hollow piston rod 70, and to the above-ground well fluid reservoir 223.

At the same time, the upper chamber 69A of the production piston chamber 69 is filled with the well fluid WF filtered through the suction strainer 119 and the inlet check valve 94.

The pumping action is momentarily stopped when the power piston 73 reaches the end of its stroke.

The flow sensing switch 212, lacking any return flow impact to keep the switch paddle disconnected, now returns to the position shown, due to the counterweight, and makes a momentary electrical contact that changes the status of the "flip-flop" 215 from "Y" to "X", energizing the solenoid X1 of the flow control valve 211 to change the flow pattern from parallel flow porting to crossed flow porting.

Now the pressurized hydraulic fluid HF is directed to the lower portion of the 41B of the power piston chamber 41 and the power piston 73 starts an up-stroke, while discharging the "spent" fluid from the upper portion 41A of chamber 41 through blocking valve 219, directional flow control valve 211, through the restricted discharge line 214, and parallel flow switch 212 to the hydraulic fluid reservoir 209.

On the up-stroke of the production piston 79, the lower chamber 69B of the production piston chamber 69 receives well fluid WF through the suction strainer 119, and inlet check valve 97, and simultaneously discharges the well fluid in the upper chamber 69A from the previous cycle, through the discharge check valve 54, into the hollow piston rod 70, and through discharge line 222 to the well fluid reservoir 223.

The up-stroke of the power piston 73, and the discharge flow of spent hydraulic fluid continues, through the restricted discharge line 214, and parallel flow switch 212 until the end of the stroke of the power piston 73, at which time the flow stops, and the flow switch 212 resets the "flip-flop" 215 to energize the outlet Y and solenoid Y1 of valve 211 to repeat the cycle over again.

At the same time, the individual well timers 221 program the time windows for the pumping unit in each well, and the time delay required for the recovery of the particular well, in combination with the process controller (not shown).

The random-sequential operation allows a plurality of pumping units 10A, 10B in nearby wells to be served with one central hydraulic power control system 200.

It should be noted, that all the hydraulic power fluid flow controls are located above ground and distanced from the corrosive environment of the well fluid, making them easily installed and accessible and thereby provides significant advantages and overcomes many problems associated with systems wherein the hydraulic fluid controls are located down-hole. It should also be noted that the present hydraulic control system utilizes electric solenoid controlled four-port directional flow control valves which can reverse the flow direction in less than 60 milliseconds, and eliminates the possibility of mid position hang-over.

OPERATION OF THE DOWNHOLE PUMPING UNIT

In FIGS. 1A and 1B, the reciprocating components of the pump 10 are shown in an intermediate position halfway between the top of the up stroke and the bottom of the down stroke.

The pump 10 is suspended inside of the well casing C by the discharge tube 14 which is connected at an upper end to a conventional support structure at the surface of the well (not shown). The interior 15 of the discharge tube 14 is connected to a discharge line which conducts the pumped well fluid into an above ground storage facility (items 222 and 223 in FIG. 4). The pump 10 is partially or totally submerged below the surface of the well fluid which enters the well casing C through the holes H in the lower end of the casing. The hydraulic fluid conduits 27 and 28 connected at their bottom ends to upper cylinder head 11 are connected with the central hydraulic power control circuit 200 (FIG. 4) at the well surface.

Pressurized hydraulic operating fluid is conducted through conduit 27, bores 22 and 24, through the annulus 20 between the inner and outer sleeve 19 and 17, through the slots 21 at the bottom of the inner sleeve 19, into the lower end of the power piston chamber 41, and to the bottom end of the power piston 73 and pushes the power piston up. The reduced diameter neck 74 at the top of the power piston 73 enters the cavity 31 in the bottom of the cylinder head 11 at the top of the up-stroke.

For the power piston down stroke, pressurized hydraulic operating fluid is conducted through conduit 28, bores 23 and 25, through the annulus 26 between the inner sleeve 19 and the reduced diameter lower end 16 of the cylinder head 11, into the upper end of the power piston chamber 41, and to the top end of the power piston 73 and pushes the power piston down. The reduced diameter neck 75 at the bottom of the power piston 73 enters the cavity 38 in the top of the guide 34 at the bottom of the down stroke.

The power piston up stroke and down stroke is cushioned by the hydraulic fluid entrapped between the cavities 31 and 38 and the reduced diameter necks 74 and 75 of the power piston 73 gradually escaping through the angular slots 77 of the reduced diameter neck portions into the chamber 41 above or below the power piston 73.

As the power piston 73 moves up and down, the elongate hollow piston rod 70, production piston 79, lower piston rod extension 111, and the suction filter or strainer 119 move with it.

During the down stroke of the power piston 73, there is a partial negative pressure in the upper production piston chamber 69A above the production piston 79 and well fluid is conducted upwardly through the suction filter or strainer 119, the bore 112 of the lower piston rod extension 111, the lower central bore 84 in the lower end of the production piston 79, the bore 88, and the bore 85, to pass upwardly through the first one-way check valve 94 at the top end of the production piston 79, and the bore 107 in the upper plate 103 to enter the upper production piston chamber 69A, but prevents it from passing downwardly. After subsequent down strokes, the upper production piston chamber 69A becomes filled with the well fluid due to the combined atmospheric pressure upon the well fluid and the hydrostatic head developed by the well fluid.

The pressure difference of the negative pressure in the upper production piston chamber 69A and the combined atmospheric and hydrostatic pressure of the well fluid opens the opposed second check valve 97 in the bottom of the production piston 79 against its spring 98, allowing the pumped well fluid to pass through the production piston unidirectionally and also enter the lower production piston chamber 69B.

At the same time, the well fluid of the previous stroke entrapped in the lower production piston chamber 69B below the production piston 79 is expelled upwardly through the bore 114 in the lower plate 104, the third one-way check valve 100, and the bores 89 and 91 and upper central bore 82 in the production piston 79 into the bore 71 of the hollow tubular piston rod 70, and ultimately into the discharge tube 14, but is prevented from passing downwardly.

The pumped well fluid may contain some gas bubbles that are carried with the discharged fluid stream to the surface where it will be separated.

During the up stroke of the production piston 79, the previously filled upper production piston chamber 69A is pressurized, and the entrapped well fluid is forced upwardly through the one-way check valve 54 and the bore 52 in the valve housing 45 and into the intermediate fluid and gas collection chamber 58 between the top end of the valve housing 45 and the bottom end of the guide member 34, and through the side bore 71A into the bore 71 of the hollow piston rod 70, and subsequently into the discharge tube 14.

Simultaneously, the lower production piston chamber 69B is filled with well fluid through the suction filter or strainer 119, the bore 112 of the lower piston rod extension 111, the central bore 84 in the lower end of the production piston 79, the bore 88, and the bore 85, which passes downward through the second one-way check valve 97 at the bottom end of the production piston 79, and the bore 113 in the lower plate 104 to enter lower production piston chamber 69B.

During the next down stroke of the production piston 79, the well fluid entrapped in the lower production piston chamber 69B below the production piston 79 is expelled upwardly through the bore 114 in the lower plate 104, the third one-way check valve 100, and the bores 89 and 91 and upper central bore 82 in the production piston 79 into the bore 71 of the hollow tubular piston rod 70, and ultimately into the discharge tube 14.

The gas bubbles in the well fluid tend to form a gas pocket P which may impede the pumping action. The present invention overcomes this problem since the contained gas is discharged directly to the discharge tube 14 during the down stroke of the production piston 79 and allowed to settle out in the intermediate fluid and gas collection chamber 58. During the top dead position in each up stroke of the production piston 79, the bore 71A in the side wall of the hollow piston rod aligns with the gas pocket P (if any) at the highest point of the fluid and gas collection chamber 58 and allows the discharge of accumulated gas through the bore 71A in the side wall of the hollow tubular piston rod 70 and through the piston rod bore 71 to the discharge tube 14. Because the check valves 94, 97, and 100 are open to the upward flow, the possibility of formation of a vapor or gas lock is eliminated.

There is a narrow annulus between the exterior of the suction filter or strainer 119 and the interior diameter of the casing C. During each up and down stroke the filter screen is flushed with the high viscosity well fluid which cleans sand deposits from the filter screen.

The whole pumping unit may be provided with sufficient side clearance to allow the pump to be installed in bowed, angular, and horizontal wells. The central hydraulic power unit may also be connected to supply pressurized hydraulic fluid to one or more fluid motors of nearby wells.

Although the present pumping unit has been described and illustrated by way of example as being disposed in a well bore in the earth surface, it should be understood, that the pumping unit may also be used in subsea wells.

While this invention has been described fully and completely with special emphasis upon a preferred embodiment, it should be understood that within the scope of the appended claims the invention may be practiced otherwise than as specifically described herein.

I claim:

1. A hydraulically actuated pump assembly for producing fluid from a formation located downhole in a borehole, comprising:

an elongate tubular main body having a cylindrical power fluid chamber and a cylindrical production fluid chamber disposed beneath said power chamber and coaxial therewith, said main body adapted to be connected at an upper end to a production fluid discharge conduit extending to the surface of said borehole;

a power piston disposed in slidable reciprocating sealed relationship in said power fluid chamber, dividing it into upper and lower power fluid chambers;

power fluid passageway means in said power fluid chamber adapted to be connected to a source of power fluid at the surface of the borehole to alternately supply and exhaust power fluid under pressure to said upper and lower power fluid chambers for reciprocating said power piston;

a production piston disposed in slidable reciprocating sealed relationship in said production fluid chamber, dividing it into upper and lower production fluid chambers;

an elongate hollow tubular piston rod disposed in slidable reciprocating sealed relationship in said main body and having an upper portion extending from said production piston through said power fluid chamber with a central bore in fluid communication with the production fluid discharge conduit, a lower portion extending through said production fluid chamber to be reciprocatingly submerged in a production fluid in said borehole with a central bore in fluid communication with the production fluid in the borehole;

said power piston connected with said piston rod upper portion in spaced relation to said production piston whereby reciprocation of said power piston causes concurrent reciprocation of said piston rod and said production piston;

a production fluid inlet passageway extending through said production piston in fluid communication with said piston rod lower portion central bore and said upper and lower production fluid chambers;

production fluid inlet valve means in said production fluid inlet passageway for conducting production fluid from said piston rod lower portion central bore into said upper and lower production fluid chambers only upon downward movement of said production piston;

a production fluid discharge passageway extending through said production piston in fluid communication with said piston rod upper portion central bore and said lower production fluid chamber; and production fluid discharge valve means in said production fluid discharge passageway for conducting production fluid from said lower production fluid chamber to said piston rod upper portion central bore and the discharge conduit only upon downward movement of said production piston.

2. The hydraulically actuated pump assembly according to claim 1 further comprising:

a cylindrical member in said main body disposed between said power fluid chamber and said upper production fluid chamber defining an intermediate production fluid and gas collection chamber through which said piston rod upper portion passes in slidable reciprocating sealed relationship;

a production fluid and gas discharge passageway extending through said cylindrical member in fluid communication with said upper production fluid chamber and said intermediate production fluid and gas chamber;

production fluid and gas discharge valve means in said production fluid and gas discharge passageway for conducting production fluid and gas from said upper production fluid chamber to said intermediate production fluid and gas collection chamber only upon upward movement of said production piston; and a production fluid and gas port in the side wall of said piston rod upper portion for conducting production fluid and gas between said intermediate production fluid and gas collection chamber and said piston rod upper portion central bore and said discharge conduit.

3. The hydraulically actuated pump assembly according to claim 1 further comprising:

filter means connected to the bottom end of said piston rod lower portion to reciprocate therewith and having a porous portion in fluid communication with said piston rod lower portion central bore through which production fluid passes upon reciprocation.

4. The hydraulically actuated pump assembly according to claim 3 wherein:

said borehole is lined with a casing; and said filter means is dimensioned relative the interior of said casing to provide an annulus therebetween sufficiently small to produce a high velocity flow of production fluid past and through said porous portion during reciprocation such that said porous portion is cleaned by said high velocity flow.

5. The hydraulically actuated pump assembly according to claim 1 wherein:

said power fluid chamber comprises an elongate tubular outer sleeve and an elongate tubular inner sleeve in concentric inwardly spaced relation thereto defining an annulus therebetween and each connected at their upper ends to a generally cylindrical cylinder head and at their lower ends to a generally cylindrical guide member, said inner sleeve having a plurality of slots at its bottom end in fluid communication with said annulus and said lower power fluid chamber;

said piston rod upper portion extending through said cylinder head and said cylindrical guide member in slidable reciprocating sealed relationship;

said power fluid passageway means in said power chamber comprises a first power fluid passageway extending through said cylinder head in fluid communication with said annulus, said slots and said lower power fluid chamber, and a second power fluid passageway extending through said cylinder head in fluid communication with said upper power fluid chamber;

a first power fluid supply conduit connected to said power fluid supply passageway and said source of power fluid to conduct power fluid in a flow path through said power fluid supply passageway, said annulus, said slots, and into said lower power fluid chamber beneath said power piston to move said power piston upwardly; and to conduct said power fluid in the reverse flow path as said power piston moves downwardly; and a second power fluid conduit connected to said second power fluid passageway and said source of power fluid to conduct power fluid in a flow path from said power fluid upper chamber above said power piston through said second power fluid passageway and to said source of power fluid as said power piston moves upwardly, and to conduct said power fluid in the reverse flow path as said power piston moves downwardly.

6. The hydraulically actuated pump assembly according to claim 1 wherein:

said production piston is a generally cylindrical member;

said production fluid inlet passageway extending through said production piston comprises a first central bore extending upwardly from the bottom end of said production piston in fluid communication with said piston rod lower portion central bore, a first vertical bore laterally spaced from said first central bore extending between the top and bottom ends of said production piston in fluid communication with said upper and lower production fluid chambers, and a lateral fluid passageway extending between said first central bore and said first vertical bore;

said production fluid inlet valve means comprises a first check valve and a second check valve disposed in opposed relation in said first vertical bore, said first and second check valves opening only upon sufficient fluid pressure in said piston rod lower portion to conduct production fluid from said piston rod lower portion central bore through said first central bore, said lateral passageway, said vertical bore and into said upper production fluid chamber through said first check valve, and into said lower production fluid chamber through said second check valve, said production fluid discharge passageway extending through said production piston comprises a second central bore extending downwardly from the top end of said production piston in fluid communication with said piston rod upper portion central bore, a vertical bore laterally spaced from said second central bore extending upwardly from the bottom end of said production piston in fluid communication with said lower production fluid chamber, and a second lateral fluid passageway extending between said second central bore and said second vertical bore; and said production fluid discharge valve means comprises a third check valve disposed in said second vertical bore to open only upon downward movement of said production piston against fluid pressure in said lower production fluid chamber to conduct production fluid from said lower production fluid chamber through said third check valve, said second vertical bore, said second lateral fluid passageway, said second central bore, into said piston rod upper portion central bore, and to said discharge conduit.

7. The hydraulically actuated pump assembly according to claim 6 further comprising:

a cylindrical member in said main body disposed between said power fluid chamber and said upper production fluid chamber defining an intermediate production fluid and gas collection chamber through which said piston rod upper portion passes in slidable reciprocating sealed relationship;

a production fluid and gas discharge passageway extending through said cylindrical member in fluid communication with said upper production fluid chamber and said intermediate production fluid and gas chamber;

production fluid and gas discharge valve means in said production fluid and gas discharge passageway for conducting production fluid and gas from said upper production fluid chamber to said intermediate production fluid and gas collection chamber only upon upward movement of said production piston; and a production fluid and gas port in the side wall of said piston rod upper portion for conducting production fluid and gas between said intermediate production fluid and gas collection chamber and said piston rod upper portion central bore and the discharge conduit.

8. The hydraulically actuated pump assembly according to claim 1 including:

a hydraulic power control system disposed at the surface of the well for controlling the operation of said power piston, comprising;

a first power fluid line connected at one end to said upper power fluid chamber and at another end to said source of power fluid and a second power fluid line connected to said lower power fluid chamber and at another end to said source of power fluid to alternately supply and discharge power fluid to said upper and lower power fluid chambers;

a positive displacement pump connected in said first power fluid line driven by a prime mover to conduct power fluid from said source of power fluid to said upper power fluid chamber;

an adjustable relief valve connected with said positive displacement pump controlled by a remotely activated solenoid pilot valve to vent said relief valve and unload said positive displacement pump, at a predetermined low pressure, to said source of power fluid;

a solenoid pilot controlled directional flow control valve connected with said first and said second power fluid lines between said positive displacement pump and said upper and lower power fluid chambers;

a fluid flow sensitive switch in said second power fluid line between said solenoid pilot controlled directional flow control valve and said source of power fluid electrically connected with said pilot solenoid controlled directional flow control valve through an electronic flip-flop signal processor;

a restricted return line between said directional control valve and said source of power fluid; and a flow blocking valve connected with said first and second power fluid lines having a solenoid connected with a timing device adjusted to the well fluid recovery cycle of the well in which said pump assembly is located.

9. The hydraulically actuated pump assembly according to claim 8 wherein:

said solenoid pilot controlled directional flow control valve conducts power fluid through said first and second power fluid lines in a parallel port mode and the fluid flow is blocked by said flow blocking valve until said flow blocking valve solenoid is activated by said timing device;

said flow blocking valve switching to a flow conduction mode upon activation of said flow blocking valve solenoid by said timing device and de-energizing said solenoid pilot valve connected with said relief valve to stop venting said relief valve and thereby allowing said positive displacement pump to build up the pressure of said power fluid in said first power fluid line and move said power piston downwardly; and simultaneously power fluid is conducted from said lower power fluid chamber through said second power fluid line through said flow blocking valve, said solenoid pilot controlled directional flow control valve, through said restricted return line, and said fluid flow sensitive switch to said source of power fluid; and as said power piston moves downwardly, said production piston is moved downwardly and said discharge valve means opens to expel production fluid from said lower production fluid chamber through said production fluid discharge passageway into said piston rod upper portion central bore and said discharge conduit to an above ground production fluid reservoir; and as said production piston moves downwardly, said upper production fluid chamber is filled with the production fluid; and upon said power piston reaching the end of its down stroke, said fluid flow sensitive switch senses the lack of return flow of power fluid and responsive thereto causes said flip-flop signal processor to energize said solenoid pilot controlled directional flow control valve to assume a crossed flow port mode and conduct power fluid through said second power fluid line through said flow blocking valve into said lower power fluid chamber and move said power piston upwardly while discharging power fluid through said second power fluid line from said upper power fluid chamber through said flow blocking valve, said solenoid pilot controlled directional flow control valve, said restricted return line, and said fluid flow sensitive switch to said source of power fluid; and upon said power piston reaching the end of its up stroke, said fluid flow sensitive switch senses the lack of return flow of power fluid and responsive thereto causes said flip-flop signal processor to energize said solenoid pilot controlled directional flow control valve to re-assume the parallel port mode and the fluid flow is again blocked by said flow blocking valve until said flow blocking valve solenoid is activated by said timing device.

10. The hydraulically actuated pump assembly according to claim 9 further comprising:

a cylindrical member in said main body disposed between said power fluid chamber and said upper production fluid chamber defining an intermediate production fluid and gas collection chamber through which said piston rod upper portion passes in slidable reciprocating sealed relationship;

a production fluid and gas discharge passageway extending through said cylindrical member in fluid communication with said upper production fluid chamber and said intermediate production fluid and gas chamber;

production fluid and gas discharge valve means in said production fluid and gas discharge passageway for conducting production fluid and gas from said upper production fluid chamber to said intermediate production fluid and gas collection chamber only upon upward movement of said production piston; and a production fluid and gas port in the side wall of said piston rod upper portion for conducting production fluid and gas between said intermediate production fluid and gas collection chamber and said piston rod upper portion central bore and the discharge conduit; and as said power piston moves upwardly, said production piston is moved upwardly, said discharge valve means in said production piston closes, production fluid and gas in said upper production fluid chamber is expelled through said production fluid and gas discharge passageway through said production fluid and gas discharge valve into said intermediate production fluid and gas collection chamber, through said production fluid and gas port in the side wall of said piston rod upper portion, into said piston rod upper portion central bore and said discharge conduit to said above ground production fluid reservoir.

11. The hydraulically actuated pump assembly according to claim 8 wherein:

a plurality of said hydraulically actuated pump assemblies are each connected with said first and second power fluid lines through a respective flow blocking valve disposed therebetween;

each of said respective flow blocking valves having a solenoid connected with a timing device adjusted to the well fluid recovery cycle of the respective well in which each said pump assembly is located; and each said timing device is adjusted to provide time windows for the operating sequence of the respective pump assembly in each well, and the time delay required for the recovery of the particular well.

12. In a hydraulically actuated pump which includes a main body adapted to be connected to a production fluid discharge conduit extending to the surface of a borehole and having a cylindrical power fluid chamber, a power piston disposed in slidable reciprocating sealed relationship in said power fluid chamber dividing it into upper and lower power fluid chambers, a cylindrical production fluid chamber disposed beneath said power fluid chamber, a production piston disposed in slidable reciprocating sealed relationship in said production fluid chamber dividing it into upper and lower production fluid chambers, an elongate hollow tubular piston rod disposed in slidable reciprocating sealed relationship in said main body and having an upper portion extending from said production piston through said power fluid chamber with a central bore in fluid communication with the production fluid discharge conduit, a lower portion extending through said production fluid chamber to be reciprocatingly submerged in a production fluid in said borehole with a central bore in fluid communication with the production fluid in the borehole, said power piston connected with said piston rod upper portion in spaced relation to said production piston whereby reciprocation of said power piston causes concurrent reciprocation of said piston rod and said production piston, the improvement which comprises:

a production fluid inlet passageway extending through said production piston in fluid communication with said piston rod lower portion central bore and said upper and lower production fluid chambers;

production fluid inlet valve means in said production fluid inlet passageway for conducting production fluid from said piston rod lower portion central bore into said upper and lower production fluid chambers only upon downward movement of said production piston;

a production fluid discharge passageway extending through said production piston in fluid communication with said piston rod upper portion central bore and said lower production fluid chamber; and production fluid discharge valve means in said production fluid discharge passageway for conducting production fluid from said lower production fluid chamber to said piston rod upper portion central bore and the discharge conduit only upon downward movement of said production piston.

13. The hydraulically actuated pump according to claim 12 further comprising:

a cylindrical member in said main body disposed between said power fluid chamber and said upper production fluid chamber defining an intermediate production fluid and gas collection chamber through which said piston rod upper portion passes in slidable reciprocating sealed relationship;

a production fluid and gas discharge passageway extending through said cylindrical member in fluid communication with said upper production fluid chamber and said intermediate production fluid and gas chamber;

production fluid and gas discharge valve means in said production fluid and gas discharge passageway for conducting production fluid and gas from said upper production fluid chamber to said intermediate production fluid and gas collection chamber only upon upward movement of said production piston; and a production fluid and gas port in the side wall of said piston rod upper portion for conducting production fluid and gas between said intermediate production fluid and gas collection chamber and said piston rod upper portion central bore and said discharge conduit.

14. The hydraulically actuated pump according to claim 12 wherein:

said production fluid inlet passageway extending through said production piston comprises a first central bore extending upwardly from the bottom end of said production piston in fluid communication with said piston rod lower portion central bore, a first vertical bore laterally spaced from said first central bore extending between the top and bottom ends of said production piston in fluid communication with said upper and lower production fluid chambers, and a lateral fluid passageway extending between said first central bore and said first vertical bore;

said production fluid inlet valve means comprises a first check valve and a second check valve disposed in opposed relation in said first vertical bore, said first and second check valves opening only upon sufficient fluid pressure in said piston rod lower portion to conduct production fluid from said piston rod lower portion central bore through said first central bore, said lateral passageway, said vertical bore and into said upper production fluid chamber through said first check valve, and into said lower production fluid chamber through said second check valve;

said production fluid discharge passageway extending through said production piston comprises a second central bore extending downwardly from the top end of said production piston in fluid communication with said piston rod upper portion central bore, a vertical bore laterally spaced from said second central bore extending upwardly from the bottom end of said production piston in fluid communication with said lower production fluid chamber, and a second lateral fluid passageway extending between said second central bore and said second vertical bore; and said production fluid discharge valve means comprises a third check valve disposed in said second vertical bore to open only upon downward movement of said production piston against fluid pressure in said lower production fluid chamber to conduct production fluid from said lower production fluid chamber through said third check valve, said second vertical bore, said second lateral fluid passageway, said second central bore, into said piston rod upper portion central bore, and to said discharge conduit.

15. The hydraulically actuated pump according to claim 14 further comprising:

a cylindrical member in said main body disposed between said power fluid chamber and said upper production fluid chamber defining an intermediate production fluid and gas collection chamber through which said piston rod upper portion passes in slidable reciprocating sealed relationship;

a production fluid and gas discharge passageway extending through said cylindrical member in fluid communication with said upper production fluid chamber and said intermediate production fluid and gas chamber;

production fluid and gas discharge valve means in said production fluid and gas discharge passageway for conducting production fluid and gas from said upper production fluid chamber to said intermediate production fluid and gas collection chamber only upon upward movement of said production piston; and a production fluid and gas port in the side wall of said piston rod upper portion for conducting production fluid and gas between said intermediate production fluid and gas collection chamber and said piston rod upper portion central bore and the discharge conduit.

16. A pumping system for controlling the operation of a plurality of hydraulically actuated pumps each disposed downhole in a respective well at various locations to produce fluid from the respective well formations comprising:

a plurality of hydraulically operated pump assemblies each having an elongate tubular main body with a cylindrical power fluid chamber and a cylindrical production fluid chamber disposed beneath said power chamber and coaxial therewith, said main body adapted to be connected at an upper end to a production fluid discharge conduit extending to the surface of the respective well, a power piston disposed in slidable reciprocating sealed relationship in said power fluid chamber dividing it into upper and lower power fluid chambers, a first and second power fluid line each connected at one end to said upper power fluid chamber and said lower power fluid chamber, respectively, of each of said plurality of pump assemblies to alternately supply and exhaust power fluid under pressure to said upper and lower power fluid chambers for reciprocating said power piston;

each said pump assembly having an elongate hollow production piston disposed in slidable reciprocating sealed relationship in said production fluid chamber dividing it into upper and lower production fluid chambers, an elongate hollow tubular piston rod disposed in slidable reciprocating sealed relationship in said main body and having an upper portion extending from said production piston through said power fluid chamber with a central bore in fluid communication with the production fluid discharge conduit, a lower portion extending through said production fluid chamber to be reciprocatingly submerged in a production fluid in the respective well with a central bore in fluid communication with the production fluid in the respective well, said power piston connected with said piston rod upper portion in spaced relation to said production piston whereby reciprocation of said power piston causes concurrent reciprocation of said piston rod and said production piston;

each said pump assembly having an elongate hollow production fluid inlet passageway extending through said production piston in fluid communication with said piston rod lower portion central bore and said upper and lower production fluid chambers, production fluid inlet valve means in said production fluid inlet passageway for conducting production fluid from said piston rod lower portion central bore into said upper and lower production fluid chambers only upon downward movement of said production piston;

each said pump assembly having a production fluid discharge passageway extending through said production piston in fluid communication with said piston rod upper portion central bore and said lower production fluid chamber, and production fluid discharge valve means in said production fluid discharge passageway for conducting production fluid from said lower production fluid chamber to said piston rod upper portion central bore and the discharge conduit only upon downward movement of said production piston;

said first and second power fluid line of each of said plurality of pump assemblies connected at another end to a common source of power fluid disposed at the surface of the respective wells;

a common hydraulic power control system disposed at the surface of the respective wells connected to said first and second power fluid lines for independently controlling the operation of said power piston of each said pump assembly, said control system comprising:

a positive displacement pump connected with said first power fluid lines driven by a prime mover to conduct power fluid from said common source of power fluid to said upper power fluid chamber of each of said plurality of pump assemblies;

an adjustable relief valve connected with said positive displacement pump controlled by a remotely activated solenoid pilot valve to vent said relief valve and unload said positive displacement pump, at a predetermined low pressure, to said common source of power fluid;

a solenoid pilot controlled directional flow control valve connected with said first and said second power fluid lines between said positive displacement pump and said upper and lower power fluid chambers;

a fluid flow sensitive switch connected with said second power fluid lines between said solenoid pilot controlled directional flow control valve and said common source of power fluid, and electrically connected with said pilot solenoid controlled directional flow control valve through an electronic flip-flop signal processor;

a restricted return line between said directional control valve and said source of power fluid; and a flow blocking valve connected in said first and second power fluid lines of each of said plurality of pump assemblies, each said flow blocking valve having a solenoid connected with a timing device adjusted to the well fluid recovery cycle of the respective well in which said pump assembly is disposed, each said timing device adjusted to provide time windows for the operating sequence of the respective pump assembly in each respective well, and the time delay required for the recovery of said respective well in which said respective pump assembly is disposed.

17. The pumping system according to claim 16 wherein:

said solenoid pilot controlled directional flow control valve conducts power fluid through said first and second power fluid lines in a parallel port mode and the fluid flow is blocked by a respective said flow blocking valve until said flow blocking valve solenoid is activated by said timing device in accordance with the fluid recovery cycle of the respective well in which said pump assembly is located;

each said flow blocking valve switching to a flow conduction mode upon activation of said flow blocking valve solenoid by said timing device and de-energizing said solenoid pilot valve connected with said relief valve to stop venting said relief valve and thereby allowing said positive displacement pump to build up the pressure of said power fluid in said first power fluid lines and move said power piston of the respective said pump assembly downwardly; and simultaneously power fluid is conducted from said lower power fluid chamber of the respective said pump assembly through its said second power fluid line through said flow blocking valve, said solenoid pilot controlled directional flow control valve, through said restricted return line, and said fluid flow sensitive switch to said common source of power fluid; and as said power piston of the respective said pump assembly moves downwardly, its said production piston is moved downwardly and its discharge valve means opens to expel production fluid from its said lower production fluid chamber through its said production fluid discharge passageway into its said piston rod upper portion central bore and said discharge conduit to an above ground production fluid reservoir; and as said production piston of the respective said pump assembly moves downwardly, is upper production fluid chamber is filled with the production fluid; and upon said power piston of the respective said pump assembly reaching the end of its down stroke, said fluid flow sensitive switch senses the lack of return flow of power fluid and responsive thereto causes said flip-flop signal processor to energize said solenoid pilot controlled directional flow control valve to assume a crossed flow port mode and conduct power fluid through said second power fluid line of the respective said pump assembly through said flow blocking valve into its said lower power fluid chamber and move its said power piston upwardly while discharging power fluid through its said second power fluid line from its said upper power fluid chamber through said flow blocking valve, said solenoid pilot controlled directional flow control valve, said restricted return line, and said fluid flow sensitive switch to said common source of power fluid; and upon said power piston of the respective said pump assembly reaching the end of its up stroke, said fluid flow sensitive switch senses the lack of return flow of power fluid and responsive thereto causes said flip-flop signal processor to energize said solenoid pilot controlled directional flow control valve to re-assume the parallel port mode and the fluid flow is again blocked by said flow blocking valve until said flow blocking valve solenoid is activated by said timing device in accordance with the fluid recovery cycle of the respective well in which the respective said pump assembly is located.

* * * * *